US012123187B2

(12) United States Patent
Dixon

(10) Patent No.: US 12,123,187 B2
(45) Date of Patent: Oct. 22, 2024

(54) ANCHOR SYSTEMS AND METHODS

(71) Applicant: SOUTHERN COMFORT SHELTERS, L.L.C., Zachary, LA (US)

(72) Inventor: Robert C. Dixon, Denham Springs, LA (US)

(73) Assignee: SOUTHERN COMFORT SHELTERS, L.L.C., Denham Springs, LA (US)

( * ) Notice: Subject to any disclaimer, the term of this patent is extended or adjusted under 35 U.S.C. 154(b) by 90 days.

(21) Appl. No.: 17/825,254

(22) Filed: May 26, 2022

(65) Prior Publication Data

US 2022/0381024 A1 Dec. 1, 2022

Related U.S. Application Data

(60) Provisional application No. 63/193,805, filed on May 27, 2021.

(51) Int. Cl.

| | |
|---|---|
| ***E04H 13/00*** | (2006.01) |
| ***B21C 47/08*** | (2006.01) |
| ***E04B 1/38*** | (2006.01) |
| ***E04H 9/04*** | (2006.01) |
| *E04B 1/32* | (2006.01) |
| *E04B 1/342* | (2006.01) |

(52) U.S. Cl.

CPC ..... *E04B 1/388* (2023.08); *B21C 47/08* (2013.01); *E04H 9/04* (2013.01); *E04B 1/3205* (2013.01); *E04B 1/342* (2013.01); *E04B 2001/389* (2023.08)

(58) Field of Classification Search

CPC ..... E04B 1/3205; E04B 1/388; B21C 47/08
USPC ..... 52/379, 296
See application file for complete search history.

(56) References Cited

U.S. PATENT DOCUMENTS

| | | | | | |
|---|---|---|---|---|---|
| 953,951 | A * | 4/1910 | Hubbard | H02G 7/10 | 248/302 |
| 2,593,714 | A * | 4/1952 | Robinson | B29C 49/44 | 156/65 |
| 2,806,668 | A * | 9/1957 | Hewes | B61L 5/026 | 267/155 |
| 2,852,797 | A * | 9/1958 | Daubenspeck | A47L 13/257 | 403/208 |
| 2,856,646 | A * | 10/1958 | Latimer | E04B 2/706 | 52/657 |
| 2,881,915 | A * | 4/1959 | Koehler | B65D 63/06 | 206/394 |
| 3,001,765 | A * | 9/1961 | Shobert | H01B 17/145 | 256/48 |
| 3,109,259 | A * | 11/1963 | Viall | B28B 23/0018 | 52/596 |
| 3,243,927 | A * | 4/1966 | Hilson | E02D 27/04 | 52/157 |

(Continued)

*Primary Examiner* — Basil S Katcheves
(74) *Attorney, Agent, or Firm* — Haynes and Boone, LLP

(57) ABSTRACT

Blast resistant shelters and structural designs therefor according to which the structural designs include anchoring systems and manufacturing of the anchoring system. The anchoring systems include at least one bracket with a spiral winding and opposing first and second end portions. The first end portion includes two holes, and the second end portion includes two holes. The spiral winding is disposed between the first end portion and the second end portion.

24 Claims, 10 Drawing Sheets

(56) References Cited

U.S. PATENT DOCUMENTS 3,602,000 A * 8/1971 Meheen ..... E02D 5/28 52/223.4
4,016,698 A * 4/1977 Rogers ..... E04C 3/02 52/656.1
4,367,973 A * 1/1983 Gilb ..... F16B 15/00 403/231
4,563,851 A * 1/1986 Long ..... E04C 2/386 52/656.1
4,843,726 A * 7/1989 Ward ..... E04B 1/10 D10/64
4,896,985 A * 1/1990 Commins ..... F16B 9/058 52/712
5,161,345 A * 11/1992 Sobjack, Sr. ..... E04B 7/022 33/669
5,284,247 A * 2/1994 Turner ..... B65D 83/0805 206/395
5,390,460 A * 2/1995 Llorens ..... E04D 3/3605 52/489.1
5,522,187 A * 6/1996 Bogaerts ..... E04D 1/34 52/489.1
5,553,822 A * 9/1996 Barnard ..... F16L 3/14 248/302
5,595,031 A * 1/1997 Commins ..... E04B 1/0007 52/712
D436,026 S * 1/2001 Luther, Sr. ..... D8/499
6,474,037 B2 * 11/2002 Thompson ..... E04B 1/2608 52/715
6,510,666 B1 * 1/2003 Thompson ..... E04B 5/12 52/489.1
6,877,291 B2 * 4/2005 Shamroukh ..... F16B 9/052 52/715
8,109,124 B2 * 2/2012 Lin ..... B21C 47/28 72/274
D673,031 S * 12/2012 Hendricks ..... D8/394
8,904,731 B2 * 12/2014 Hohmann, Jr. ..... E04B 1/4178 52/713
10,011,981 B2 * 7/2018 Sica ..... E04B 1/343
11,702,846 B1 * 7/2023 Calomiris ..... F16B 21/02 52/712
D1,000,924 S * 10/2023 Calomiris ..... D8/354
2014/0174689 A1 * 6/2014 Karlsson ..... D21F 3/0236 29/460
2016/0160499 A1 * 6/2016 Moeller ..... F03D 13/20 52/698

* cited by examiner

ANCHOR SYSTEMS AND METHODS

CROSS-REFERENCE TO RELATED APPLICATIONS

This application claims the benefit of the filing date of, and priority to, U.S. Patent Application No. 63/193,805, filed on May 27, 2021, the entire disclosure of which is hereby incorporated by reference.

This application is related to U.S. Application No. 62/484,482, filed Apr. 12, 2017, the entire disclosure of which is hereby incorporated herein by reference.

This application is also related to U.S. application Ser. No. 15/674,741, filed Aug. 11, 2017, now U.S. Pat. No. 10,260,229, the entire disclosure of which is hereby incorporated herein by reference.

This application is further related to International Application No. PCT/US2018/027048 filed Apr. 18, 2018, the entire disclosure of which is hereby incorporated herein by reference.

This application is also related to U.S. application Ser. No. 16/269,169, filed Feb. 6, 2019, now U.S. Pat. No. 11,174,629, the entire disclosure of which is hereby incorporated herein by reference.

BACKGROUND

This application relates generally to blast resistant shelters and anchor systems and, more particularly, to anchor systems and methods for manufacturing anchor systems for blast resistant shelters.

DETAILED DESCRIPTION

Figure 1:
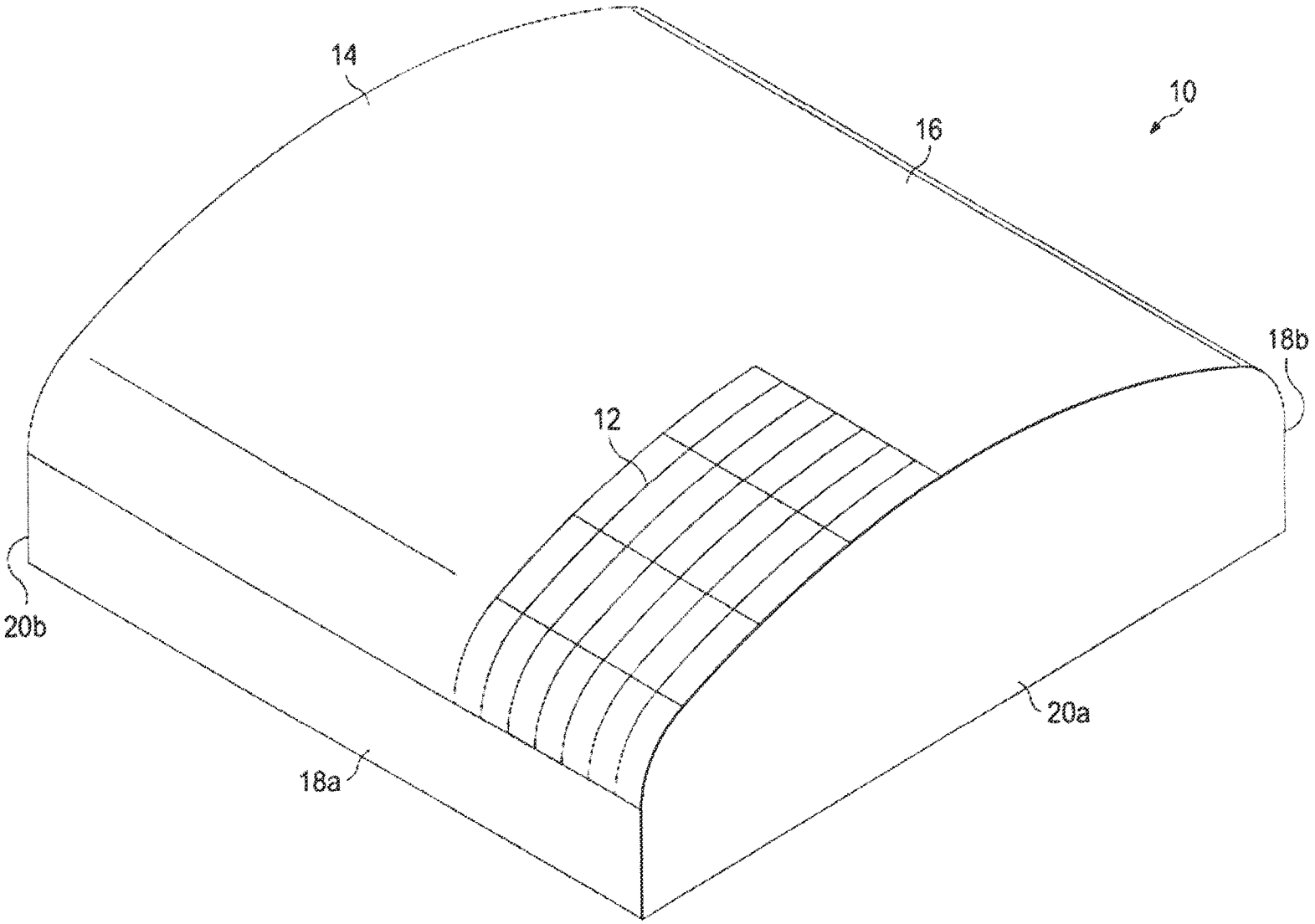
FIG. 1 is perspective view of an illustrative embodiment of a blast resistant shelter, according to one or more embodiments of the present disclosure.

It is to be understood that the present disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiment and/or configurations discussed.

Referring to FIG. 1, in an embodiment, a blast resistant shelter is generally referred to by reference numeral 10. The blast resistant shelter 10, which includes a frame 12 and a canopy 14. The frame 12 and the canopy 14 together define a roof 16, walls 18*a* and 18*b*, and gable ends 20*a* and 20*b*.

Figure 2:
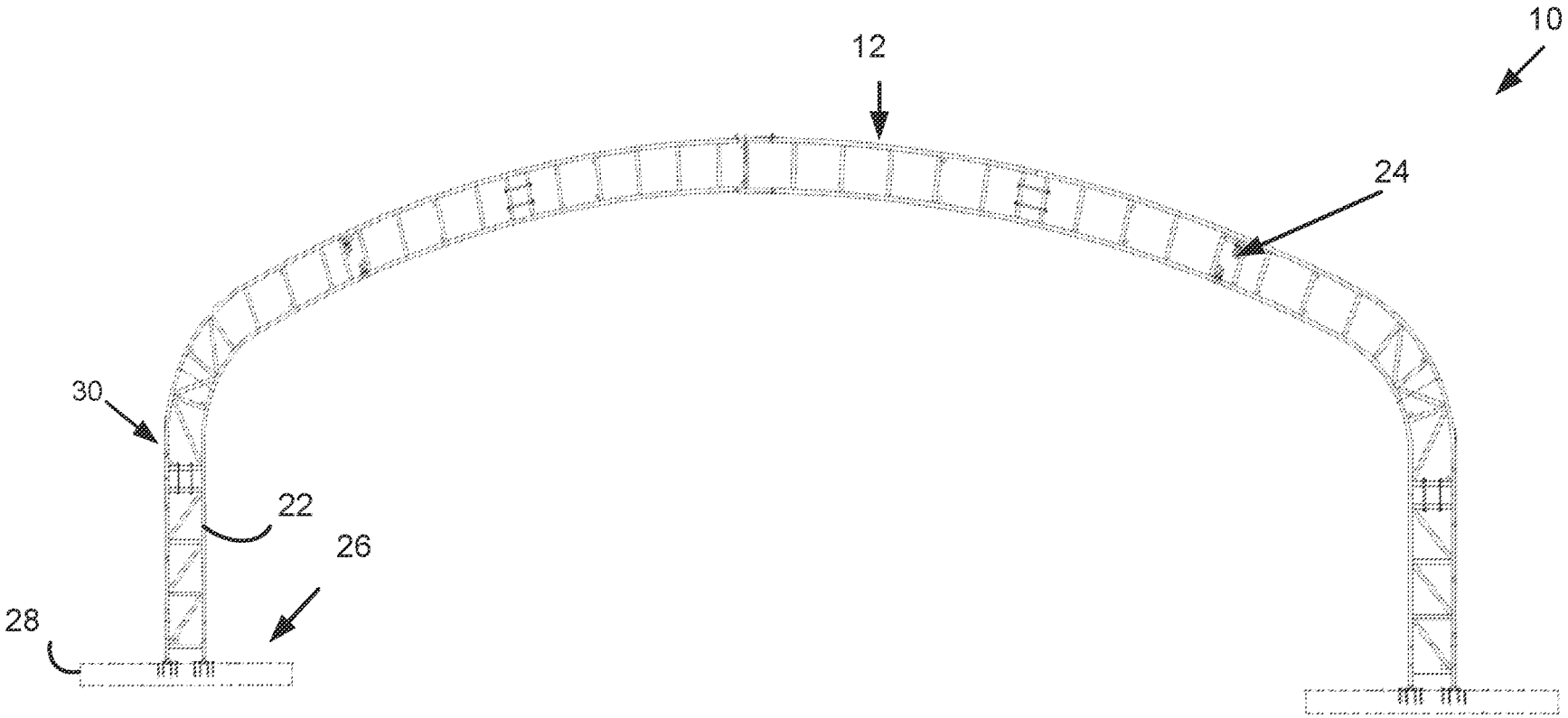
FIG. 2 is a cross-sectional schematic illustration of the blast resistant shelter of FIG. 1 and an anchor system, according to one or more embodiments of the present disclosure.

With continuing reference to FIG. 1, FIG. 2 displays a cross-sectional view of the blast resistant shelter 10. The frame 12 includes a plurality of structural members such as, for example, trusses 22. The trusses 22 are also interconnected by roof bracing 24. The roof bracing 24 maintains the substantially parallel spacing of the trusses 22; additionally, the roof bracing 24 prevents, or at least reduces, torsional strain on the trusses 22 when the blast resistant shelter 10 is in use. The blast resistant shelter 10 includes an anchoring system 26. The anchoring system 26 couples the blast resistant shelter 10 to a perimeter slab 28.

In some embodiments, the perimeter slab 28 is the ground, slab, concrete, or the like around the perimeter of the blast resistant shelter 10.

In some embodiments, the structural design of the blast resistant shelter 10 is such that there are no guy wires on the respective exteriors of the blast resistant shelter 10. In one or more embodiments, the blast resistant shelter 10 includes flexible panels 30 that may flap independently of one another in response to, for example, a blast, explosion, or some other event. In some embodiments, flexible panels 30 may be made of, for example, fabric materials.

Figure 3:
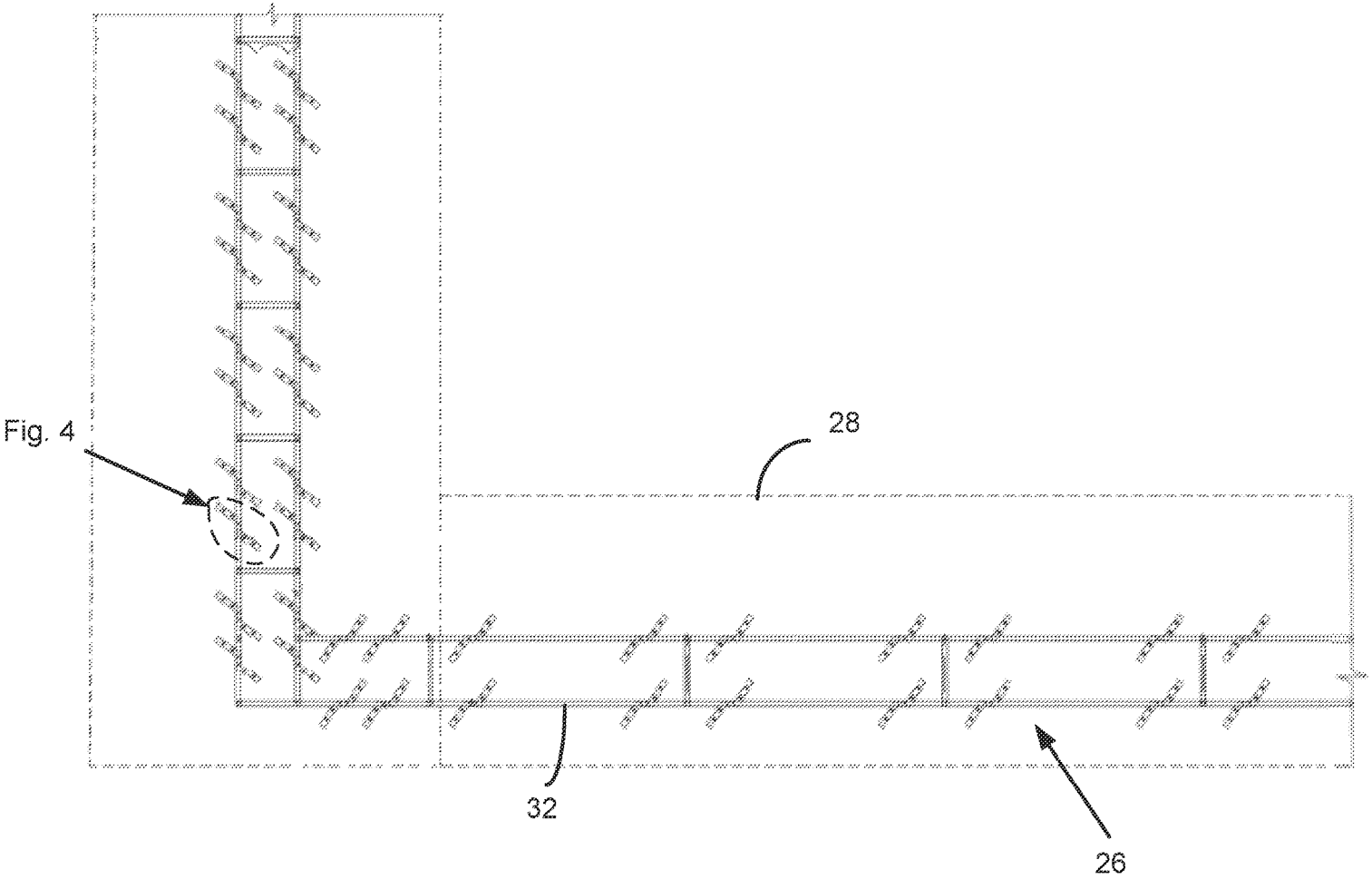
FIG. 3 is a plan view schematic illustration of a portion of the blast resistant shelter and anchor system of FIG. 2, according to one or more embodiments of the present disclosure.

Referring to FIG. 3, a plan view of a portion of the blast resistant shelter 10 is shown. This portion of the blast resistant shelter 10 includes base beams 32 that are secured by the anchoring system 26. The base beams 32 of the blast resistant shelter 10 are anchored into the perimeter slab 28 by the anchoring system 26.

In some embodiments, each of the base beams 32 is a 1.9" diameter 15 gauge round base beam. In one or more embodiments, the base beams 32 are made of steel, metal, and the like.

Figure 4:
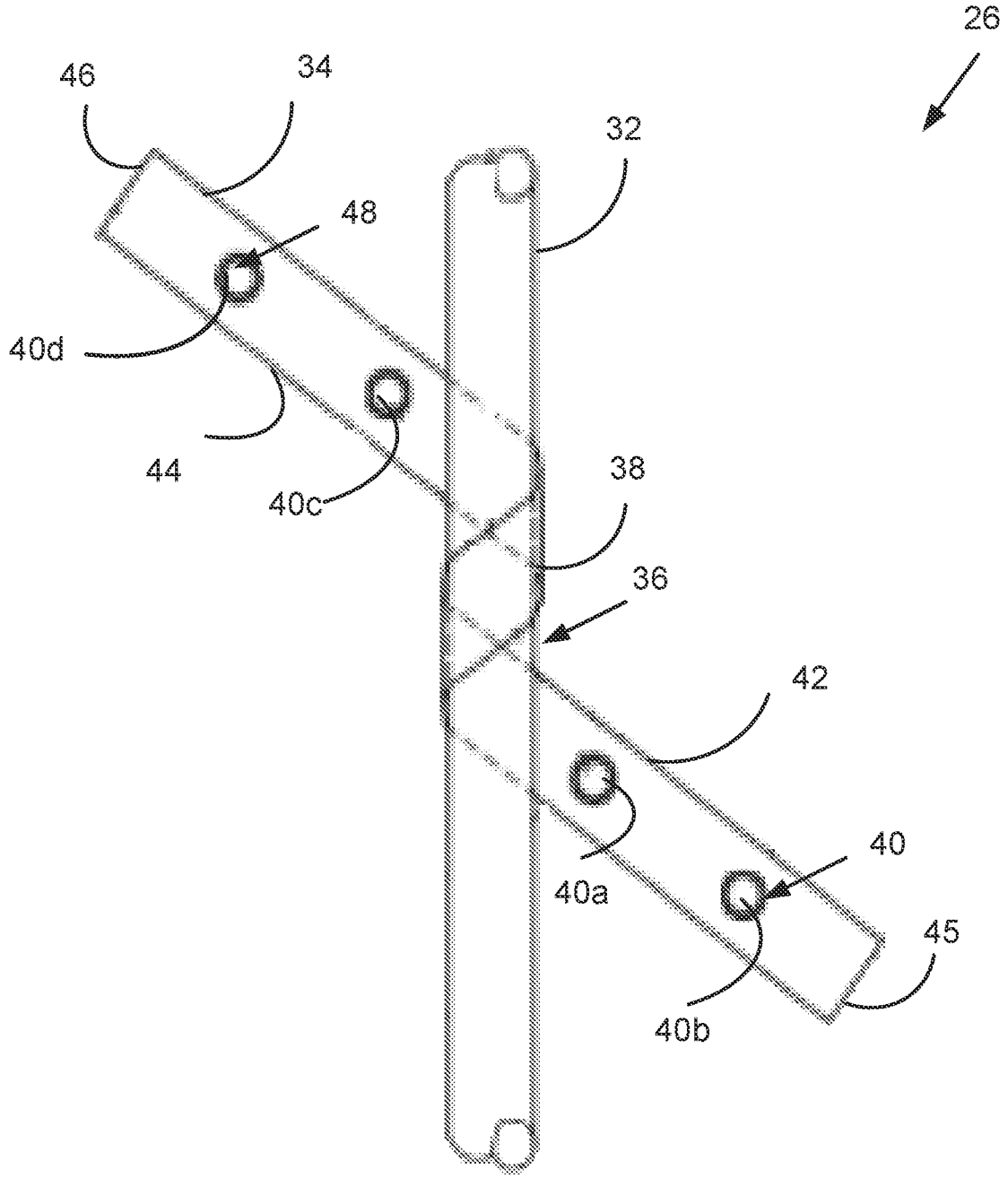
FIG. 4 is a diagrammatic illustration of a portion of the anchor system of FIG. 3, according to one or more embodiments of the present disclosure.

Referring to FIG. 4, with continued reference to FIGS. 1-3, one embodiment of the anchoring system 26 is shown. The anchoring system 26 is a bracket 34 extending spirally around the base beam 32 so that the base beam 32 extends through a generally cylindrically shaped internal region 36 defined by a spiral winding 38 of the bracket 34. One or more holes 40 may be included in bracket 34. The bracket 34 includes a first end portion 42 and a second end portion 44. The bracket includes a first distal end 45 and a second distal end 46. Anchoring system 26 includes two holes 40*a* and 40*b* located on the first end portion 42 and two holes 40*c* and 40*d* located on the second end portion 44. Holes 40*a* and 40*b* are through openings positioned between the spiral winding 38 and the first distal end 45. Holes 40*c* and 40*d* are through openings positioned between the spiral winding 38 and the second distal end 46.

In one or more embodiments, the length of the bracket 34 is 28 inches. In some embodiments, the length between 40*a* and 40*b* is four inches and the length between 40*b* and the first distal end 45 is three inches. In one or more embodiments, the length between 40*c* and 40*d* is four inches and the length between 40*d* and the second distal end 46 is three inches.

In some embodiments, the length between the center of hole 40*a* to the center of hole 40*c* is defined by L1. The length of L1 may be 8⅞ inches in one or more embodiments. The length of L1 may linearly extend from the center of hole 40*a* to the center of hole 40*c*.

In some embodiments, the bracket 34 is held in place using one or more screw anchors 48 per one or more holes 40. In other embodiments, other screws, fasteners, and the like may be used in the one or more holes 40.

In some embodiments, the anchoring system 26 includes the base beam 32, the bracket 34, and the one or more screw anchors 48. In other embodiments, the anchoring system 26 includes the base beam 32, two brackets 34, and eight or more screw anchors 48. In one or more embodiments, the anchoring system 26 includes the base beam 32, the bracket 34, the one or more screw anchors 48, and the perimeter slab 28.

In one or more embodiments, spiral winding 38 is a helical or spiral portion of the bracket 34.

In operation, the bracket 34 of anchoring system 26 is wrapped around an outer diameter of the base beam 32. The bracket 34 is moved along the base beam 32 to the appropriate location. Using a screw anchor 48 per hole 40, screw four screw anchors of the one or more screw anchors 48 into the holes 40*a*, 40*b*, 40*c*, and 40*d* respectively and into the perimeter slab 28 to couple the bracket 34 to the perimeter slab and to secure the base beam 32 of the the blast resistant shelter 10.

In some embodiments, two screw anchors 48 may be used per bracket 34. In other embodiments, four screw anchors 48 may be used per bracket 34. In yet another embodiment, eight screw anchors 48 may be used per bracket 34.

In some embodiments, three holes 40 may be drilled into each of the first end portion 42 and the second end portion 44. In other embodiments, eight holes of the one or more holes 40 may be on the bracket 34. In some embodiments, the number of holes 40 equals the number of screw anchors 48 used. In other embodiments, the number of holes 40 does not match the number of screw anchors 48 used.

Figure 5:
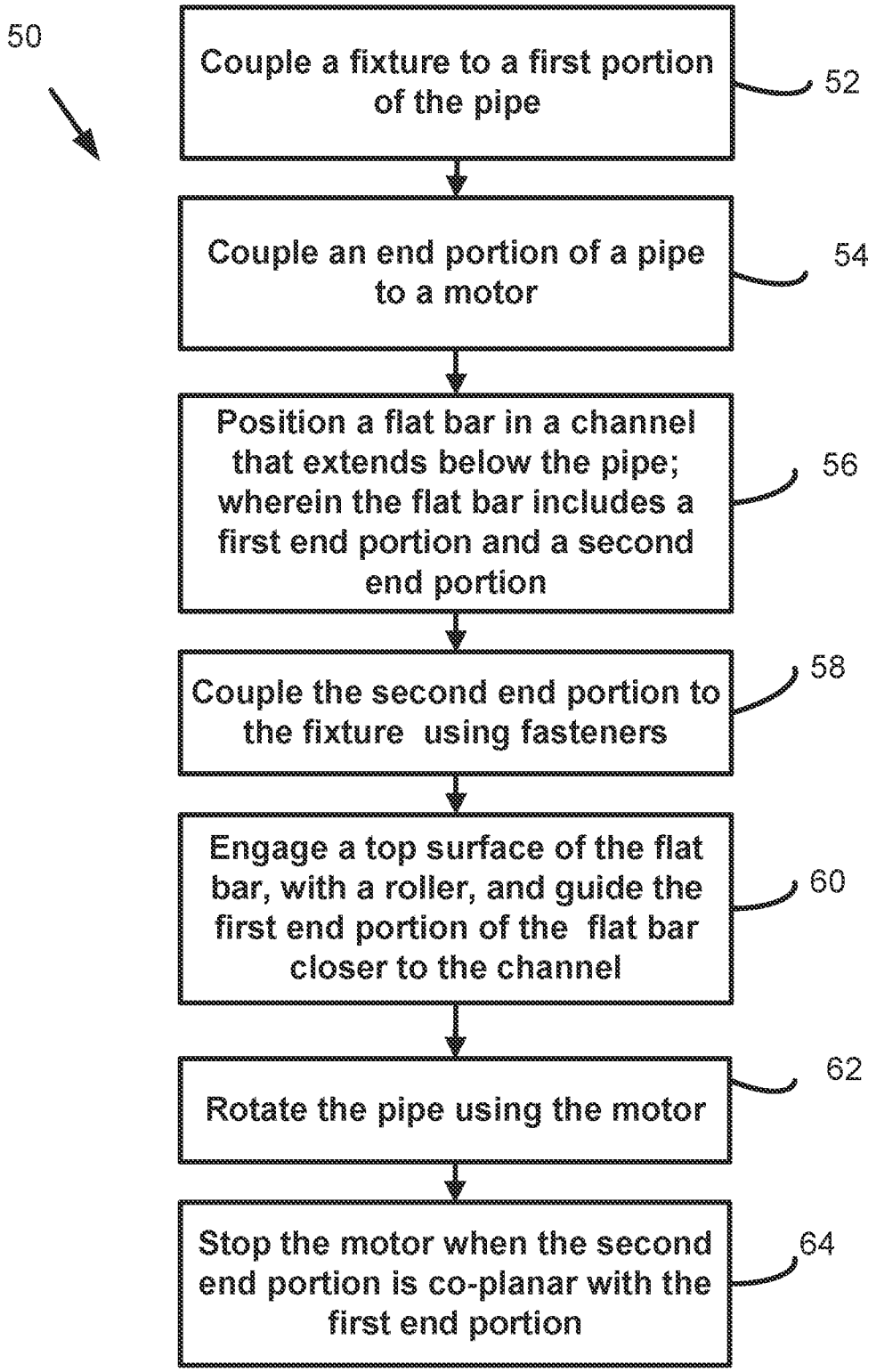
FIG. 5 is a flow chart diagram of a method of manufacturing the anchor system of FIGS. 2-4, according to one or more embodiments of the present disclosure.

Referring to FIG. 5, a flow chart showing one method for manufacturing the bracket 34. It is understood that additional steps can be provided before, during, and after the steps of method 50, and that some of the steps described can be replaced or eliminated for other implementations of method 50. In one embodiment, the method 50 includes: coupling a fixture to a first portion of the pipe in a step 52; coupling an end portion of a pipe to a motor in a step 54; positioning a flat bar in a channel that extends below the pipe, wherein the flat bar includes a first end portion and a second end portion in a step 56; coupling the second end portion to the fixture using fasteners in a step 58; engaging a top surface of the flat bar with a roller and guiding the first end portion of the flat bar closer to the channel at a step 60; rotating the pipe using the motor at a step 62; and stopping the motor when the second end portion is co-planar with the first end portion at a step 64.

Figure 6A:
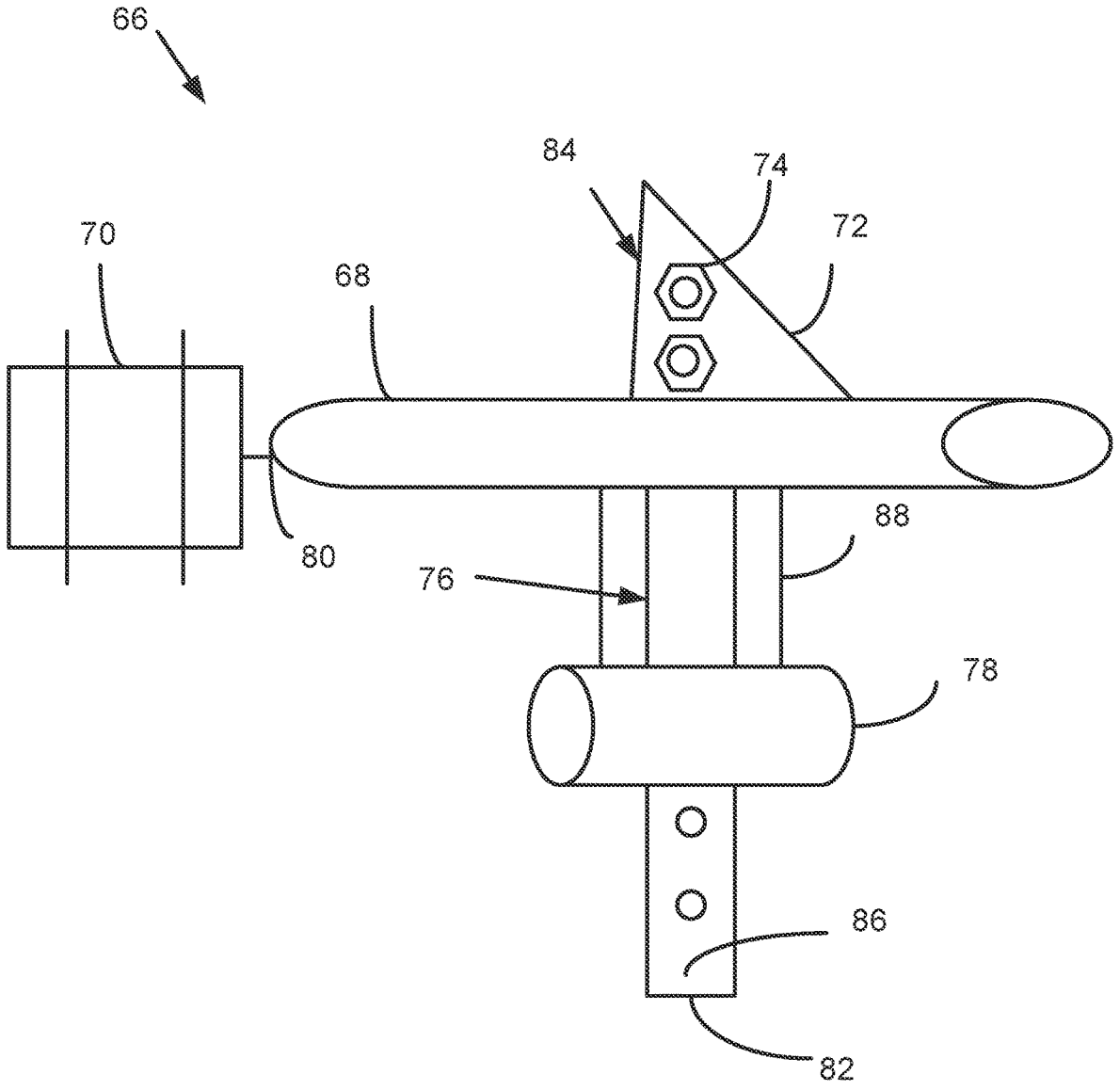
FIG. 6A is a diagrammatic illustration of one portion of the method of manufacturing the anchor system of FIG. 5, according to one or more embodiments of the present disclosure.
Figure 6B:
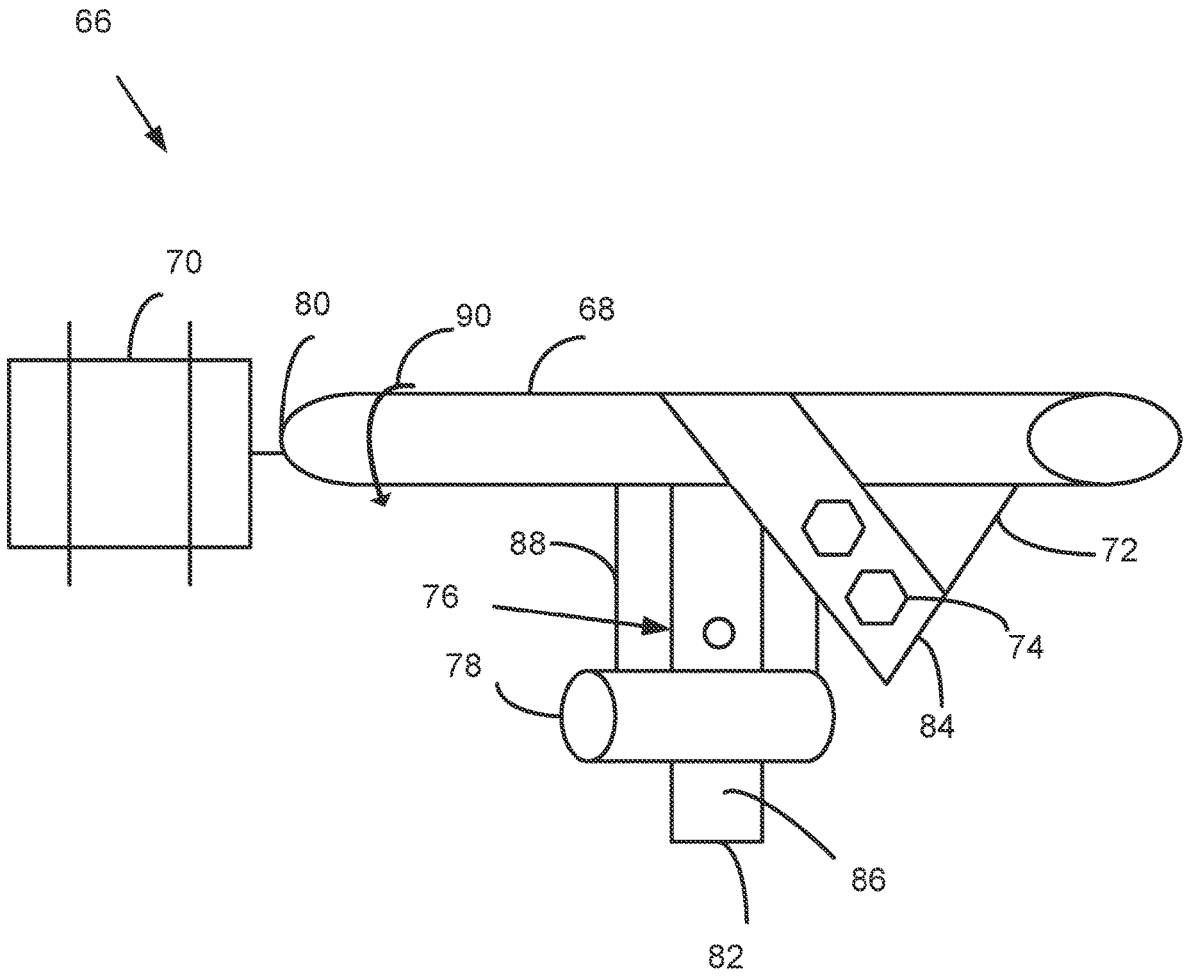
FIG. 6B is another diagrammatic illustration of another portion of the method of manufacturing the anchor system of FIG. 5, according to one or more embodiments of the present disclosure.
Figure 6C:
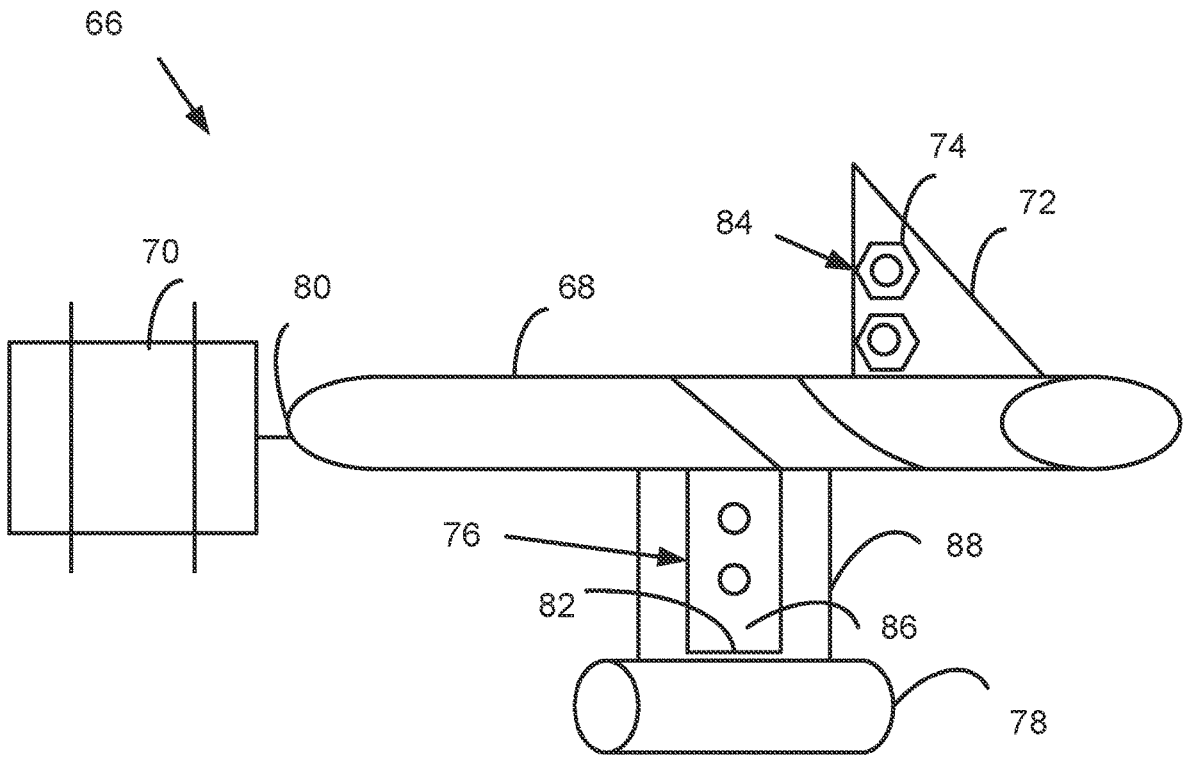
FIG. 6C is yet another diagrammatic illustration of another portion of the method of manufacturing the anchor system of FIG. 5, according to one or more embodiments of the present disclosure.

Referring to FIG. 6A-6C, with continuing reference to FIG. 5, equipment for manufacturing the bracket 34 is generally referred to by reference numeral 66. The equipment 66 includes a pipe 68, a motor 70, a fixture 72, one or more fasteners 74, a flat bar 76, and a roller 78. The pipe 68 is operably coupled to the motor 70. In particular, the pipe 68 includes a first end portion 80 that is operably coupled to the motor 70. The fixture 72 is coupled to another portion of the pipe 68. The fixture 72 extends orthogonally to the pipe 68. The one or more fasteners 74 couple the flat bar 76 to the fixture 72. The flat bar 76 includes a first end portion 82, an opposing second end portion 84, and a top surface 86. In some embodiments, the first end portion 82 of the flat bar 76 includes two holes and the second end portion 84 includes another two holes. The holes are through-openings. In particular, the second end portion 84 of the flat bar 76 is coupled to the fixture 72 using the holes and the one or more fasteners 74. The fixture 72 is already coupled to the pipe 68, thus now the second end portion 84 of the flat bar 76 is coupled to the pipe 68. The first end portion 82 of the flat bar 76 is placed in a channel 88 that extends below the pipe 68. The roller 78 engages or is otherwise proximate the top surface 86 of the flat bar 76, the roller 78 extending transversely or perpendicularly to the extension of the flat bar 76, immediately before an end of the channel 88 into which the flat bar 76 extends.

In some embodiments, the pipe 68 is a pipe, shaft, spindle, or the like. In some embodiments, the end of the pipe 68 that opposes the first end portion 80 is supported by bearings, a support structure, or other device to keep the pipe 68 level while rotating.

In some embodiments, the one or more fasteners 74 are bolts, clamps, screws, and the like.

In several embodiments, the holes and/or through-openings are formed by drilling through the flat bar. In some embodiments, the holes on the first end portion 82 of the flat bar 76 and the holes of the second end portion 84 of the flat bar 76 include two through-openings; in other embodiments, the holes on the first end portion 82 of the flat bar 76 and the holes of the second end portion 84 of the flat bar 76 include three through-openings; in other embodiments, the holes on the first end portion 82 of the flat bar 76 includes a quantity of through-openings that is different from the quantity of through-openings of the of the second end portion 84 of the flat bar 76. In some embodiments, one or both of the first end portion 82 and the second end portion 84 of the flat bar 76 include one through-opening.

In some embodiments, the fixture 72 is permanently coupled to the pipe 68 by welding. In other embodiments, the fixture 72 is removable from the pipe 68 by a fastener and the like. In one or more embodiments, the fixture 72 is coupled to the pipe 68 after the second end portion 84 is coupled to the fixture 72. In some embodiments, the fixture 72 is coupled to the first portion of the pipe 68, and the first portion of the pipe 68 is closer to the first end portion 80 of the pipe 68 than the opposing end of the pipe 68. In other embodiments, the fixture 72 is coupled to the first portion of the pipe 68, and the first portion of the pipe 68 is closer to the opposing end of the pipe 68 than the first end portion 80 of the pipe 68. In some embodiments, the fixture 72 is in the shape of a quadrilateral. In other embodiments, the fixture 72 is in the shape of a triangle.

In operation and referring to FIG. 6A, with continuing reference to FIG. 5, the fixture 72 is coupled to a first portion of the pipe 68 in the step 52; the first end portion 80 of the pipe 68 is coupled to the motor 70 in the step 54; the flat bar 76 is positioned in the channel 88 that extends proximate to the pipe 68 in the step 56; and the second end portion 84 of the flat bar 76 is coupled to the fixture 72 using the fasteners 74 in the step In some embodiments, the step 54 occurs prior to the step 52. In some embodiments, step 52 and step 54 are omitted. In some embodiments, steps 52 and 54 occur at a time prior to manufacturing the bracket 34. In one or more embodiments, the step 58 occurs prior or contemporaneously with the step 56. In some embodiments, proximate to the pipe 68 includes below, beside, near, and the like.

Referring to FIG. 6B, with continuing reference to FIGS. 5 and 6A, the roller 78 engages the top surface 86 of the flat bar 76 and guides the first end portion 82 of the flat bar 76 closer to the channel 88 in the step 60 and the pipe 68 is rotated using the motor 70 in the step 62. In particular, the motor 70 causes the pipe 68 to rotate in place, causing the fixture 72 to wrap around the pipe and thus the second end portion 84 of the flat bar 76 to wrap around, or spirally wind around, the pipe 68, and further causing the first end portion 82 of the flat bar 76 to be drawn into the channel. As the first end portion 82 of the flat bar 76 is drawn into the channel 88, the roller 78 rotates in place, maintaining the planar extension of the first end portion 82. The rotation of the pipe 68 by the motor 70 is referred to by reference numeral 90.

In some embodiments, the step 62 occurs prior to the step 60. In one or more embodiments, the step 60 and the step 62 occur contemporaneously.

In some embodiments, the rotation 90 is counterclockwise. In other embodiments, the rotation 90 is clockwise.

Referring to FIG. 6C, with continuing reference to FIGS. 5 and 6A-6B, the motor 70 continues to rotate the pipe 68. The motor 70 is stopped when the second end portion 84 is generally coplanar with the first end portion 82 at which point the motor is stopped at the step 64.

After step 64, the flat bar 76 is now the bracket 34 with the first end portion 82 of the flat bar 76 corresponding to the first end portion 42 of the bracket 34 and the second end portion 84 corresponding to the second end portion 44 of the bracket 34 and the through-holes of the flat bar 76 corresponding to holes 40 of bracket 34.

In some embodiments, the first end portion 42 of the bracket 34 corresponds with the second end portion 84 of the flat bar 76 and the second end portion 44 of the bracket 34 corresponds to the first end portion 82 of the flat bar 76.

In some embodiments, the through-holes of the flat bar 76 are a total of four holes. In other embodiments, the through-holes of the flat bar 76 are a total of six holes. In yet another embodiment, the through-holes of the flat bar are two or more holes.

In some embodiments, the method of manufacturing the bracket 34 further includes: unfastening the fasteners 74 from the fixture 72 to remove the second end portion 84 from the fixture 72 and sliding the bracket 34 off the pipe 68.

With continuing reference to FIGS. 4-6C, the bracket 34 includes the spiral winding 38 and the opposing first end portion 42 and second end portion 44 including the holes 40*a* and 40*b* on the first end portion 42 and holes 40*c* and 40*d* on the second end portion 44, respectively and the spiral winding 38 disposed between the first and second end portions 42 and 44, respectively.

Figure 7:
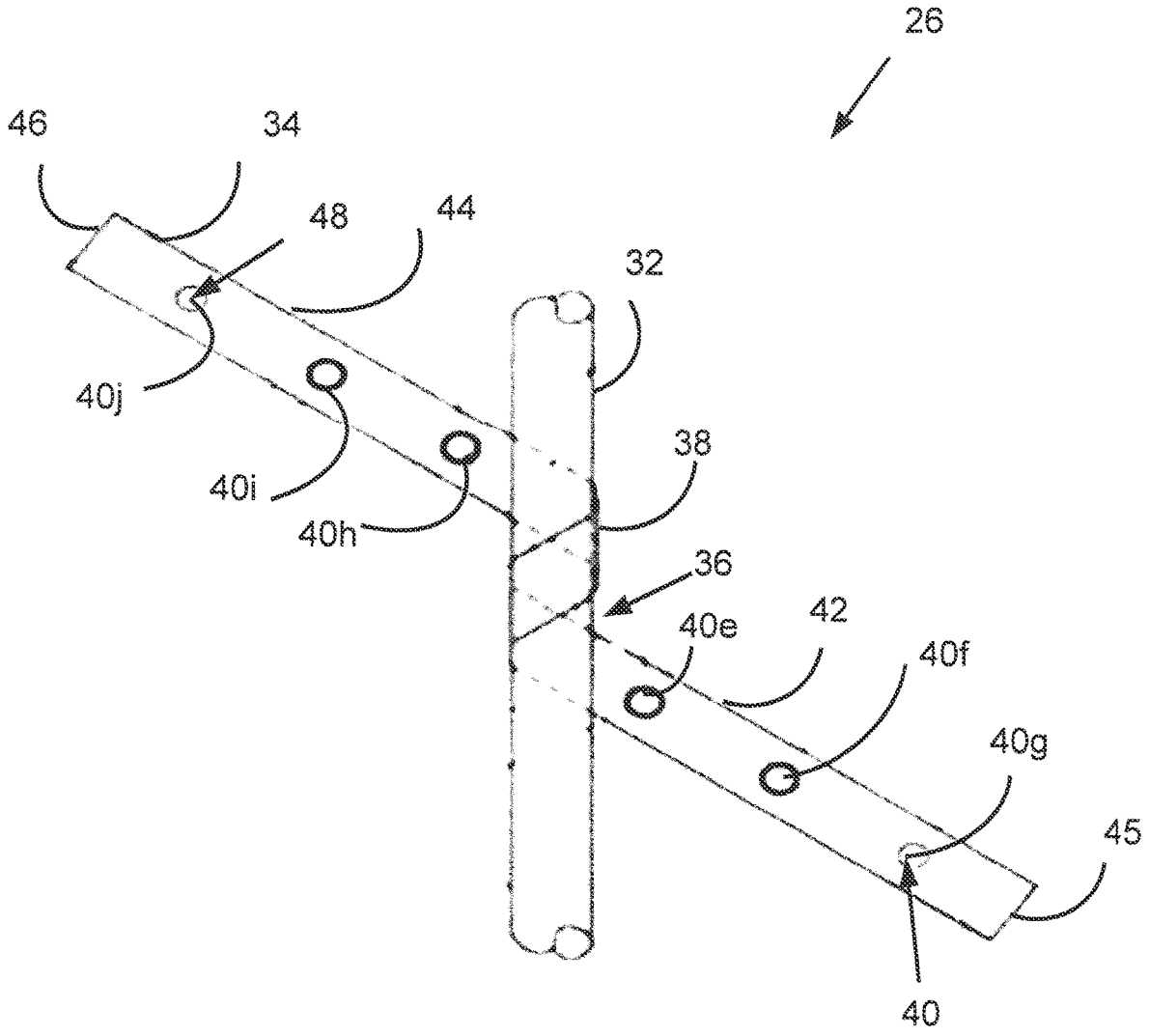
FIG. 7 is another diagrammatic illustration of the anchor system of FIG. 2, according to one or more embodiments of the present disclosure.

Referring to FIG. 7, another embodiment of the anchoring system 26 is shown and contains some of the components as shown in FIGS. 2, 3, and 4, and these components are given the same reference numerals. Anchoring system 26 includes three holes 40*e*, 40*f*, and 40*g* on the first end portion 42 and three holes 40*h*, 40*i*, and 40*j* on the second end portion 44. Holes 40*e*, 40*f*, and 40*g* are through-openings located on the first end portion 42 that are positioned between the spiral winding 38 and the first distal end 45. Holes 40*h*, 40*i*, and 40*j* are through-openings located on the second end portion 44 that are positioned between the spiral winding 38 and the second distal end 46. The length of the bracket 34 is 36 inches.

In some embodiments, the length between the center of hole 40*e* to the center of hole 40*h* is defined by L1. The length of L1 may be 8⅞ inches in one or more embodiments. The length L1 may extend linearly from the center of hole 40*e* to the center of hole 40*h*. In some embodiments, the length between 40*g* and 40*f* is four inches; the length between 40*f* and 40*e* is four inches; and the length between 40*g* and the first distal end 45 is 3 inches. In some embodiments, the length between 40*j* and 40*i* is four inches; the length between 40*i* and 40*h* is four inches; and the length between 40*j* and the second distal end 46 is 3 inches.

Figure 8:
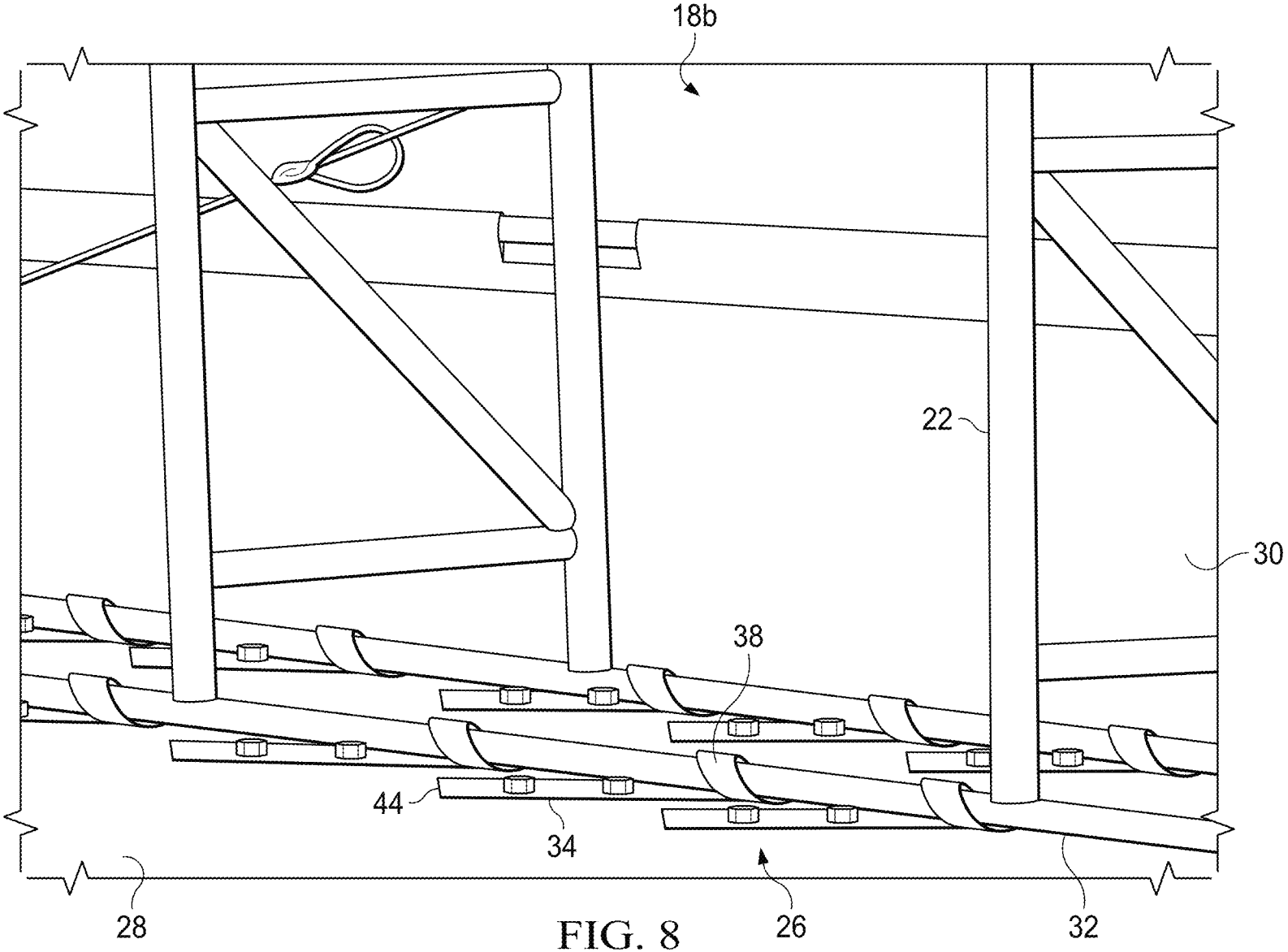
FIG. 8 is a perspective illustration of the anchor system of FIG. 2, according to one or more embodiments, of the present disclosure.

Referring to FIG. 8, a perspective view of an embodiment of the anchoring system 26 is shown and contains some of the components as shown in FIGS. 1, 2, 3, and 4, and these components are given the same reference numerals. A portion of wall 18*b* is shown and includes trusses 22 and flexible panels 30. The anchoring system 26 includes base beam 32, bracket 34, the spiral winding 38 of bracket 34, and the perimeter slab 28. The second end portion 44 of bracket 34 extends away from wall 18*b*, whereas the first end portion 42 (not shown) extends toward wall 18*b*.

With continuing reference to FIGS. 4, 7, and 8, in one or more embodiments, an angle between a first side of a base beam 32 and a first side of the first end portion 42 measures 55 degrees. In one or more embodiments, an angle between an opposing second side of base beam 32 and a first side of the second end portion 44 measures 55 degrees. In one or more embodiments, one bracket 34 is placed on one base beam 32. In other embodiments, two brackets 34 are placed on one base beam 32. In yet another embodiment, three or more brackets 34 are placed on one base beam 32. In some embodiments, two brackets 34 are used per side of 1.9" diameter base beam 18 as shown in FIG. 2.

In other embodiments, there may be more holes 40 than screw anchors 48.

In some embodiments, the cylindrically shaped internal region 36 is defined by two spiral windings 38 of the bracket 34. In one or more embodiments, the cylindrically shaped internal region 36 is defined by three or more spiral windings 38 of the bracket 34.

In one or more embodiments, only two holes of the one or more holes 40 are included: one on the first end portion 42 and one on the second end portion 44 of the bracket 34. In one or more embodiments, the one or more holes 40 measure 13⁄16" diameter holes.

In some embodiments, the bracket 34 is made of 2"×3⁄16" thick steel. In other embodiments, the bracket 34 is made of 2"×9 GA (gauge) Thick GR. 50 (grade fifty steel). In other embodiments, the bracket 34 is made of steel, metal, or the like. In some embodiments, the bracket 34 is integrally formed. In one or more embodiments, the total length of the bracket 34 is 36 inches. In other embodiments, the total length of the bracket 34 is 24 inches. In yet another embodiment, the total length of the bracket 34 is 48 inches or more.

In one or more embodiments, the screw anchor 48 is a carbon steel anchor such as, but not limited to, ¾" Hilti KWIK HUS® EZ carbon steel anchor, or equal type.

The present disclosure introduces an anchoring system that generally includes: a bracket adapted to be connected to a slab, including: a first end portion and an opposing second end portion; wherein the first and second end portions include first and second distal ends, respectively; wherein the first end portion includes one or more holes formed therethrough; and wherein the second end portion includes one or more holes formed therethrough; and a spiral winding; wherein the spiral winding extends between the first end portion and the second end portion; and wherein the spiral winding defines an internal region through which a beam is adapted to extend. In one or more embodiments, the anchoring system further includes: the slab to which the bracket is connected; the beam, which defines an outer diameter and extends through the internal region defined by the spiral winding, wherein the internal region is a cylindrically shaped internal region and the outer diameter is sized so that the beam fits within, and extends through the cylindrically shaped internal region of the spiral winding; and anchor screws, which extend through the holes, respectively, of the first and second end portions, and further extend into the slab to connect the bracket to the slab; the one or more holes of the first end portion are positioned between the spiral winding and the first distal end; and the one or more holes of the second end portion are positioned between the spiral winding and the second distal end. In one or more embodiments, the internal region is a cylindrically shaped internal region. In one or more embodiments, the anchoring system further includes the beam; wherein the beam defines an outer diameter; and the outer diameter is sized so that the beam fits within, and extends through, the cylindrically shaped internal region of the spiral winding. In one or more embodiments, the anchoring system further includes anchor screws extending through the respective holes of the first and second end portions. In one or more embodiments, the anchor screws extend into the slab to connect the bracket to the slab. In one or more embodiments, the one or more holes of the first end portion are positioned between the spiral winding and the first distal end; and the one or more holes of the second end portion are positioned between the spiral winding and the second distal end.

The present disclosure introduces an anchoring apparatus that generally includes: a first end portion and an opposing second end portion; wherein the first and second end portions include first and second distal ends, respectively; wherein the first end portion includes one or more holes formed therethrough; and wherein the second end portion includes one or more holes formed therethrough; and a spiral winding; wherein the spiral winding extends between the first end portion and the second end portion; and wherein the first end portion, the opposing second end portion, and the spiral winding are integrally formed. In one or more embodiments, the spiral winding defines an internal region through which a beam is adapted to extend; wherein the internal region is a cylindrically shaped internal region; the one or more holes of the first end portion are positioned between the spiral winding and the first distal end; and the one or more holes of the second end portion are positioned between the spiral winding and the second distal end. In one or more embodiments, the spiral winding defines a cylindrically shaped internal region through which a beam is adapted to extend. In one or more embodiments, the one or more holes of the first end portion are positioned between the spiral winding and the first distal end; and the one or more holes of the second end portion are positioned between the spiral winding and the second distal end.

The present disclosure introduces a method of manufacturing an anchor apparatus that generally includes positioning a flat bar in a channel that extends proximate a pipe, wherein the flat bar includes a first end portion and a second end portion; and wherein a fixture is coupled to the pipe; coupling the second end portion of the flat bar to the fixture; rotating the pipe, using a motor, so that the flat bar spirally winds around the pipe; and stopping the motor when the second end portion is co-planar with the first end portion. In one or more embodiments, the method further includes: coupling the pipe to the motor, wherein the pipe is rotatable about a longitudinal axis; coupling the fixture to the pipe; wherein the fixture extends orthogonally from the pipe; forming one or more holes in the first end portion of the flat bar; forming one or more holes in the second end portion of the flat bar; coupling the second end portion of the flat bar to the fixture comprises extending one or more fasteners through the one or more holes formed in the second end portion; and engaging a top surface of the flat bar with a roller to guide the first end portion of the flat bar to the channel, wherein engaging the top surface of the flat bar with a roller occurs contemporaneously with rotating the pipe using the motor and wherein the roller extends transversely to the top surface of the flat bar and is positioned immediately before an end of the channel. In one or more embodiments, the method further includes: engaging a top surface of the flat bar with a roller to guide the first end portion of the flat bar to the channel. In one or more embodiments, engaging the top surface of the flat bar with a roller occurs contemporaneously with rotating the pipe using the motor. In one or more embodiments, the roller extends transversely to the top surface of the flat bar and is positioned immediately before an end of the channel. In one or more embodiments, the method further includes forming one or more holes in the first end portion of the flat bar; and forming one or more holes in the second end portion of the flat bar. In one or more embodiments, coupling the second end portion of the flat bar to the fixture includes extending one or more fasteners through the one or more holes formed in the second end portion. In one or more embodiments, the method further includes coupling the pipe to the motor, wherein the pipe is rotatable about a longitudinal axis; and coupling the fixture to the pipe; wherein the fixture extends orthogonally from the pipe.

It is understood that variations may be made in the foregoing without departing from the scope of the present disclosure.

In several embodiments, the elements and teachings of the various embodiments may be combined in whole or in part in some or all of the embodiments. In addition, one or more of the elements and teachings of the various embodiments may be omitted, at least in part, and/or combined, at least in part, with one or more of the other elements and teachings of the various embodiments.

Any spatial references, such as, for example, "upper," "lower," "above," "below," "between," "bottom," "vertical," "horizontal," "angular," "upwards," "downwards," "side-to-side," "left-to-right," "right-to-left," "top-to-bottom," "bottom-to-top," "top," "bottom," "bottom-up," "top-down," etc., are for the purpose of illustration only and do not limit the specific orientation or location of the structure described above.

In several embodiments, while different steps, processes, and procedures are described as appearing as distinct acts, one or more of the steps, one or more of the processes, and/or one or more of the procedures may also be performed in different orders, simultaneously and/or sequentially. In several embodiments, the steps, processes, and/or procedures may be merged into one or more steps, processes and/or procedures.

In several embodiments, one or more of the operational steps in each embodiment may be omitted. Moreover, in some embodiments, some features of the present disclosure may be employed without a corresponding use of the other features. Moreover, one or more of the above-described embodiments and/or variations may be combined in whole or in part with any one or more of the other above-described embodiments and/or variations.

Although several embodiments have been described in detail above, the embodiments described are illustrative only and are not limiting, and those skilled in the art will readily appreciate that many other modifications, changes and/or substitutions are possible in the embodiments without materially departing from the novel teachings and advantages of the present disclosure. Accordingly, all such modifications, changes, and/or substitutions are intended to be included within the scope of this disclosure as defined in the following claims. In the claims, any means-plus-function clauses are intended to cover the structures described herein as performing the recited function and not only structural equivalents, but also equivalent structures. Moreover, it is the express intention of the applicant not to invoke 35 U.S.C. § 112(f) for any limitations of any of the claims herein, except for those in which the claim expressly uses the word "means" together with an associated function.

What is claimed is:

1. An anchoring system, comprising:

a bracket adapted to be connected to a slab, the bracket comprising:

a first end portion and an opposing second end portion;

wherein the first and second end portions include first and second distal ends, respectively;

wherein the first end portion and the second end portion are coplanar;

wherein the first end portion includes one or more holes formed therethrough;

and wherein the second end portion includes one or more holes formed therethrough;

and a spiral winding;

wherein the spiral winding extends between the coplanar first and second end portions; and wherein the spiral winding defines an internal region extending therethrough in a first linear direction and through which said internal region a beam is adapted to extend.

2. The anchoring system of claim 1, further comprising:

the slab to which the bracket is connected;

the beam, which defines an outer diameter and extends through the internal region defined by the spiral winding, wherein the internal region is a cylindrically shaped internal region and the outer diameter is sized so that the beam fits within, and extends through the cylindrically shaped internal region of the spiral winding;

and anchor screws, which extend through the holes, respectively, of the first and second end portions, and further extend into the slab to connect the bracket to the slab;

wherein the one or more holes of the first end portion are positioned between the spiral winding and the first distal end; and wherein the one or more holes of the second end portion are positioned between the spiral winding and the second distal end.

3. The anchoring system of claim 1, wherein the internal region is a cylindrically shaped internal region.

4. The anchoring system of claim 3, further comprising:

the beam;

wherein the beam defines an outer diameter; and wherein the outer diameter is sized so that the beam fits within, and extends through, the cylindrically shaped internal region of the spiral winding.

5. The anchoring system of claim 1, further comprising:

anchor screws extending through the respective holes of the first and second end portions.

6. The anchoring system of claim 5, the slab, wherein the anchor screws extend into the slab to connect the bracket to the slab.

7. The anchoring system of claim 6, further comprising:

the slab, to which the bracket is connected.

8. The anchoring system of claim 1, wherein the one or more holes of the first end portion are positioned between the spiral winding and the first distal end;

and wherein the one or more holes of the second end portion are positioned between the spiral winding and the second distal end.

9. The anchoring system of claim 1, wherein the coplanar first and second end portions extend from the spiral winding in opposing directions so that:

the first end portion extends from the spiral winding in a second linear direction;

the extension of the first end portion defines a first angle between:

the second linear direction in which the first end portion extends from the spiral winding; and the first linear direction in which internal region extends through the spiral winding;

the second end portion extends from the spiral winding in a third linear direction;

the third linear direction is opposite the second linear direction; and the third linear direction defines a second angle between:

the third linear direction in which the second end portion extends from the spiral winding; and the first linear direction in which internal region extends through the spiral winding.

10. The anchoring system of claim 9, wherein the second angle is equal to the first angle;

wherein each of the first and second angles is an acute angle; and wherein each of the coplanar first and second end portions extends tangentially from the spiral winding.

11. The anchoring system of claim 10, wherein each of the first and second angles is 55 degrees.

12. The anchoring system of claim 9, wherein the second angle is equal to the first angle.

13. The anchoring system of claim 9, wherein each of the first and second angles is an acute angle.

14. The anchoring system of claim 9, wherein each of the coplanar first and second end portions extends tangentially from the spiral winding.

15. An anchoring apparatus, comprising:

a first end portion and an opposing second end portion;

wherein the first and second end portions include first and second distal ends, respectively;

wherein the first end portion and the second end portion are coplanar;

wherein the first end portion includes one or more holes formed therethrough;

and wherein the second end portion includes one or more holes formed therethrough;

and a spiral winding;

wherein the spiral winding extends between the coplanar first and second end portions;

wherein the spiral winding defines an internal region extending therethrough in a first linear direction and through which said internal region a beam is adapted to extend; and wherein the first end portion, the opposing second end portion, and the spiral winding are integrally formed.

16. The anchoring apparatus of claim 15, wherein the spiral winding defines an internal region through which a beam is adapted to extend;

wherein the internal region is a cylindrically shaped internal region;

wherein the one or more holes of the first end portion are positioned between the spiral winding and the first distal end; and wherein the one or more holes of the second end portion are positioned between the spiral winding and the second distal end.

17. The anchoring apparatus of claim 15, wherein the spiral winding defines a cylindrically shaped internal region through which a beam is adapted to extend.

18. The anchoring apparatus of claim 15, wherein the one or more holes of the first end portion are positioned between the spiral winding and the first distal end; and wherein the one or more holes of the second end portion are positioned between the spiral winding and the second distal end.

19. The anchoring apparatus of claim 15, wherein the coplanar first and second end portions extend from the spiral winding in opposing directions so that:

the first end portion extends from the spiral winding in a second linear direction;

the extension of the first end portion defines a first angle between:

the second linear direction in which the first end portion extends from the spiral winding; and the first linear direction in which internal region extends through the spiral winding;

the second end portion extends from the spiral winding in a third linear direction;

the third linear direction is opposite the second linear direction; and the third linear direction defines a second angle between:

the third linear direction in which the second end portion extends from the spiral winding; and the first linear direction in which internal region extends through the spiral winding.

20. The anchoring apparatus of claim 19, wherein the second angle is equal to the first angle;

wherein each of the first and second angles is an acute angle; and wherein each of the coplanar first and second end portions extends tangentially from the spiral winding.

21. The anchoring apparatus of claim 20, wherein each of the first and second angles is 55 degrees.

22. The anchoring apparatus of claim 19, wherein the second angle is equal to the first angle.

23. The anchoring apparatus of claim 19, wherein each of the first and second angles is an acute angle.

24. The anchoring apparatus of claim 19, wherein each of the coplanar first and second end portions extends tangentially from the spiral winding.

* * * * *